US008043494B2

(12) United States Patent
Ozum

(10) Patent No.: US 8,043,494 B2
(45) Date of Patent: Oct. 25, 2011

(54) METHOD FOR IMPROVING BITUMEN RECOVERY FROM OIL SANDS BY PRODUCTION OF SURFACTANTS FROM BITUMEN ASPHALTENES

(75) Inventor: Baki Ozum, Edmonton (CA)

(73) Assignee: Apex Engineering Inc.

( * ) Notice: Subject to any disclaimer, the term of this patent is extended or adjusted under 35 U.S.C. 154(b) by 1140 days.

(21) Appl. No.: 11/720,782

(22) PCT Filed: Dec. 9, 2005

(86) PCT No.: PCT/CA2005/001875

§ 371 (c)(1),
(2), (4) Date: Jun. 4, 2007

(87) PCT Pub. No.: WO2006/060917

PCT Pub. Date: Jun. 15, 2006

(65) Prior Publication Data

US 2010/0147742 A1 Jun. 17, 2010

(30) Foreign Application Priority Data

Dec. 9, 2004 (CA) ..... 2488749

(51) Int. Cl.
*C10C 3/02* (2006.01)

(52) U.S. Cl. ..... 208/44; 208/6; 208/390; 208/391

(58) Field of Classification Search ..... 208/6, 44, 208/390–391

See application file for complete search history.

(56) References Cited

U.S. PATENT DOCUMENTS

| | | | | |
|---|---|---|---|---|
| 3,296,117 | A * | 1/1967 | Ross et al. | 208/391 |
| 3,330,757 | A * | 7/1967 | Bichard | 208/391 |
| 3,331,765 | A * | 7/1967 | Canevari et al. | 208/391 |
| 3,607,720 | A * | 9/1971 | Paulson | 208/391 |
| 3,938,590 | A * | 2/1976 | Redford et al. | 166/270.1 |
| 4,405,446 | A * | 9/1983 | Kruyer | 208/188 |
| 4,438,816 | A * | 3/1984 | Urban et al. | 166/303 |
| 4,494,992 | A | 1/1985 | Schilling | |
| 5,622,920 | A | 4/1997 | Rivas | |

FOREIGN PATENT DOCUMENTS

| | | |
|---|---|---|
| CA | 2095037 | 5/1992 |
| CA | 2306523 A1 | 4/2001 |
| CA | 2421474 A1 | 9/2003 |
| CA | 2433522 A1 | 12/2003 |
| CA | 2457603 A1 | 11/2004 |

OTHER PUBLICATIONS

Shue, F.F. et al. (1981). "A Comparison of Asphaltenes from Naturally Occurring Shale Bitumen and Retorted Shale Oils: The Influence of Temperature on Asphaltene Structure," in Oil Shale, Tar Sands, and Related Materials, Ch 9, pp. 129-138.*

* cited by examiner

*Primary Examiner* — Walter Griffin
*Assistant Examiner* — Brian McCaig

(57) ABSTRACT

In a method for increasing the efficiency of bitumen recovery from oil sands, bitumen asphaltenes naturally present in the oil sands ore are treated with selected chemical agents to produce surfactants which reduce surface and interfacial tensions and promote the production of bitumen-water emulsions, thus facilitating the extraction and recovery of bitumen for use in producing synthetic crude oil. The agents react with the asphaltenes by oxidation, sulfonation, sulfoxidation, or sulfomethylation reactions, or by a combination of such reactions. These reactions may be initiated by adding selected agents into water-based oil sand slurries in process vessels or in pipelines. Alternatively, the agents may be injected directly into subsurface oil sand formations for in situ production of surfactants to enhance the efficiency of in situ thermal bitumen recovery processes. The methods of the invention may also be used to improve the stability of bitumen-water emulsions to facilitate transportation of the emulsions by pipeline, and to enhance the recoverability of bitumen from oil sands tailings.

10 Claims, No Drawings

METHOD FOR IMPROVING BITUMEN RECOVERY FROM OIL SANDS BY PRODUCTION OF SURFACTANTS FROM BITUMEN ASPHALTENES

FIELD OF THE INVENTION

The present invention relates to methods for increasing the efficiency of bitumen recovery from oil sands using water-slurry-based and in situ extraction processes. More particularly, the invention relates to methods for producing surfactants from bitumen asphaltenes present in oil sands, to promote the formation of bitumen-water emulsions and thereby to facilitate bitumen recovery. The invention also relates to production of stable bitumen-water emulsions as a result of the production of surfactant species from bitumen asphaltenes, to facilitate pipeline transportation of bitumen in the form of bitumen-water emulsions.

BACKGROUND OF THE INVENTION

The oil sands deposits of northern Alberta, Canada are estimated to contain about 142 billion cubic meters (or 890 billion barrels) of bitumen, constituting the largest oil sands deposit in the world. Since the 1960s, bitumen recovered these deposits has been upgraded to make synthetic crude oil at production rates as high as one million barrels per day.

Bitumen is commonly recovered from the surface-mined oil sands ore using water-slurry-based extraction processes. Asphaltic acids, which are fractions of the bitumen asphaltenes present in bitumen and contain partly aromatic, oxygen-functional groups such as phenolic, carboxylic, and sulfonic types, become water-soluble, especially when the ore-water slurry's pH (i.e., acidity expressed as the minus logarithm of the hydrogen ion concentration: $pH=-\log [H^+]$) is slightly over 7, and act as surfactants reducing the surface and interfacial tensions. The reduction of surface and interfacial tensions in an oil sands ore-water slurry system causes disintegration of the ore structure and the resultant liberation of bitumen from the ore. Therefore, the water-soluble fractions of bitumen asphaltenes in oil sands play an important role in the recovery of bitumen from the surface-mined oil sands ore.

Recovery of bitumen from deep oil sands formations may be accomplished by thermal methods such as underground bitumen combustion (i.e., in situ combustion, or ISC), or steam injection methods such as steam-assisted gravity drainage (SAGD) and cyclic steam simulation (CSS). In these methods, the thermal energy injected into deep oil sands formations reduces the bitumen's viscosity and increases its mobility within the reservoir. Steam produced as an ISC by-product, or steam injected into a subsurface oil sands seam, condenses due to thermal energy losses and forms bitumen-water emulsions, which may be recovered by means of production wells. Water-soluble asphaltic acids also help the formation of the bitumen-water emulsions under in situ recovery conditions, since they act as surfactants reducing surface and interfacial tensions, thereby helping to break down the oil sands ore structure and promoting the release of bitumen from the ore.

If an emulsion is not sufficiently stable, the emulsified material (such as bitumen particles or droplets) will tend to flocculate or coalesce, leading to breakdown of the emulsion, which could hamper or preclude pipeline transportation of the emulsion. The production of surfactant species from bitumen asphaltenes would promote the formation of stable bitumen-water emulsions, thereby facilitating pipeline transportation of bitumen in the form of a bitumen-water emulsion.

For the reasons discussed above, there is a need for new methods for producing surfactants from bitumen asphaltenes to promote and enhance the formation of stable bitumen-water emulsions during both water-slurry-based and in situ processes for recovering bitumen from oil sands deposits, and thereby to improve bitumen recovery efficiency. There is a particular need for such methods which will result in reduced the amount of water required for water-slurry-based bitumen recovery processes. There is also a need for such methods which can make effective use of process waste products such as petroleum coke utilization flue gas. As well, there is a need for such methods which may be used in deep oil sands ore seams with the secondary beneficial effect of thermally insulating the ore seams, thus enhancing the efficiency of in situ thermal methods of bitumen recovery. There is a further need for new methods for producing surfactants which are also adaptable for use in association with bitumen-hydrocarbon mixtures and heavy crude oils. Further yet, there is a need for such methods which can be used over a wide range of temperatures and pH values. The present invention is directed to the foregoing needs.

BRIEF SUMMARY OF THE INVENTION

In general terms, the present invention is a method for increasing the efficiency of bitumen recovery from oil sands by treating oil sands ore with chemical agents to produce surfactants from bitumen asphaltenes present in the ore. In accordance with the invention, bitumen asphaltenes are chemically modified to form surfactant species by means of oxidation, sulfonation, sulfoxidation, or sulfomethylation reactions, or by a combination of such reactions. The resultant surfactants reduce surface and interfacial tensions so as to promote the release of bitumen from the ore, thus facilitating the extraction and recovery of bitumen for use in producing synthetic crude oil, and to promote the formation stable bitumen-water emulsions to facilitate transportation of bitumen by pipeline.

Oil sands ore may be treated in accordance with the invention either in situ or after incorporation into an oil sands ore-water slurry, depending on the nature of the particular bitumen-recovery process being used. The methods of the invention can also be used in association with other oil sands extraction and processing steps and equipment, including but not limited to ore conditioning vessels, ore-water slurry pipeline systems, primary and secondary extraction vessels, flotation vessels, and tailings streams containing residual bitumen (including oil sands tailings, cyclone overflow streams, cyclone underflow streams, mature fine tailings, and any composite non-segregating tailings streams).

DETAILED DESCRIPTION OF THE PREFERRED EMBODIMENT

In accordance with a first embodiment of the invention, one or more oxidation agents are introduced into an oil sands ore-water slurry or, alternatively, into a subsurface oil sands seam in conjunction with the injection of steam into the seam. The oxidation agent or agents may be selected from the group consisting of air oxygen (i.e., $O_2$ as a constituent of air), ozone ($O_3$), and a mixture of air oxygen and ozone. However, other agents having effective oxidizing properties may also be used, without departing from the scope of the present invention.

In accordance with a second embodiment, one or more sulfonation agents are introduced into an oil sands ore-water slurry or a subsurface oil sands seam. The sulfonation agent (or agents) may be selected from the group consisting of sulfur dioxide ($SO_2$) gas, sodium sulfite ($Na_2SO_3$), and sodium bi-sulfite ($NaHSO_3$). However, other chemical agents having effective sulfonation properties may also be used, without departing from the scope of the present invention.

In accordance with a third embodiment, both oxidation agents and sulfonation agents are introduced into the slurry or subsurface seam. Such use of sulfonation agents in conjunction with oxidation agents may be referred to as sulfoxidation. As will be explained in greater detail herein, sulfoxidation reactions may also be initiated by use of sulfoxidation agents such as petroleum coke utilization flue gas or other agents providing a source of both sulfur (in the form of sulfur dioxide or other compounds) and oxygen.

Since other constituents of oil sands ore are typically stable and non-reactive, the agents (or additives) referred to above will typically react only with the bitumen asphaltenes, whether in association with water-slurry-based extraction methods or in situ thermal recovery methods. A selected sulfonation additive could be used as the sole additive to produce surfactants from bitumen asphaltenes. Alternatively, a combination of additives could be used in simultaneous or alternating fashion. As an example, an ozone-air mixture would be a suitable oxidant to produce effective amounts of surfactant species by oxidizing bitumen asphaltenes in water-slurry-based extraction processes. If an ozone-air mixture is used as an oxidation agent, and if there is a need to increase the solubility of already oxidized bitumen asphaltenes, this may be accomplished by sulfonation and sulfoxidation of asphaltenes—such as, for example, by using $SO_2$. When ozone is selected as the oxidation agent, the injection of $SO_2$ is preferably made after the injection of ozone.

Sulfoxidation of bitumen asphaltenes to improve bitumen recovery efficiency may also be accomplished by controlled injection of petroleum coke utilization flue gas into the ore-water slurry or subsurface oil sands seam. Petroleum coke is a by-product of known bitumen upgrading processes used in the production of synthetic crude oil from oil sands bitumen. Several million tons of petroleum coke are produced each year in the northern Alberta oil sands region, and tens of millions of tons are currently stockpiled.

Petroleum coke produced from northern Alberta oil sands typically consists of about 79.9% carbon (C), 1.9% hydrogen (H), 4.6% oxygen ($O_2$), 1.7% nitrogen ($N_2$), 6.8% sulfur (S), and 7.1% ash, and has a calorific value of about 29.5 MJ/kg (megaJoules per kilogram). The ash is typically composed of about 41.3% silicon dioxide ($SiO_2$), 25.1% aluminum oxide ($Al_2O_3$), 10.9% ferric oxide ($Fe_2O_3$), 3.6% titanium dioxide ($TiO_2$), 1.3% nickel oxide (NiO), 3.7% vanadium pentoxide ($V_2O_5$), and 14.1% other oxides, which need to be considered during the selection of the petroleum utilization process. Petroleum coke can be combusted directly, which may require a specially designed boiler (e.g., down shut feed) because of its low combustibility as a result of its low (10 $m^2/g$) specific surface area. If the petroleum coke is directly combusted with 50% excess air, the flue gas mole percent composition would be approximately 12.8% $CO_2$; 7.0% $O_2$; 79.5% $N_2$; 0.2% $NO_x$; and 0.4% $SO_2$. Excess $O_2$ and $SO_2$ species present in the flue gas can be effective to react with bitumen asphaltenes to produce sufficient sulfoxidation reactions to produce surfactant species effective to enhance bitumen recovery efficiency in accordance with the present invention. If necessary or desired, the $SO_2$ composition of the flue gas can be improved by oxidizing $H_2S$ or S to $SO_2$; both $H_2S$ and S are readily available in the northern Alberta oil sands region.

In alternative embodiments of the method of the invention, petroleum coke may be gasified, and a fraction of the gasification product gas (the composition of which will depend on the selected gasification process) may be further processed to produce hydrogen ($H_2$) which may be used in known bitumen upgrading processes. The other fraction of the gasification product gas may be combusted to produce steam. The gaseous by-products would be mainly composed of $CO_2$ and $N_2$. The $N_2$ content of the flue gas injected into subsurface oil sands seams, in accordance with the present invention, will have the effect of thermally insulating the seams. Nitrogen injected into a subsurface seam will tend to migrate to the interfacial region between the seam and overlying soil strata (overburden), forming a nitrogen "blanket" that helps to retain thermal heat (from injected steam) within the seam, thereby reducing thermal energy losses to the overburden and enhancing the efficiency of in situ thermal recovery processes.

In accordance with the present invention as described to this point, oxidation, sulfonation, and/or sulfoxidation reactions are initiated by exposing oil sands bitumen to oxidation agents such as air oxygen ($O_2$) air, ozone ($O_3$), and/or sulfonation agents such as sulfur dioxide ($SO_2$) gas, sodium sulfite ($Na_2SO_3$) or sodium bi-sulfite ($NaHSO_3$), and/or petroleum coke utilization flue gas which is rich in excess air oxygen ($O_2$) and $SO_2$. The resultant oxidation, sulfonation, and/or sulfoxidation of bitumen asphaltenes produces hydrophilic functional groups of hydroxyl (—OH), aldehyde (—HC═O), ketone (C═O), carboxyl (—COOH), and sulfonyl (—C—$SO_3$—) types, and bitumen asphaltenes containing these functional groups are known to have surfactant properties.

Methods for modification of bitumen asphaltenes to surfactant species in accordance with the present invention are not limited to oxidation, sulfonation, and/or sulfoxidation reactions. In accordance with a further embodiment, other surfactant species be formed by sulfomethylation of bitumen asphaltenes by introducing one or more sulfomethylation agents such as formaldehyde ($H_2CO$) into ore-water slurries or subsurface oil sands seams, preferably in conjunction with the introduction of sulfonation and/or sulfoxidation agents. The sulfomethylation reactions result in the formation of hydrophilic methyl sulfonyl (C—$CH_2$—$SO_2$—O—) functional groups, which are effective to reduce surface and interfacial tensions. Other chemical agents having effective sulfomethylation properties may also be used, without departing from the scope of the present invention.

If necessary or desired, the solubility of the oxidation, sulfonation and/or sulfoxidation and/or sulfomethylation reaction products may be increased by using pH-adjusting additives such as, but not limited to, sodium hydroxide (NaOH) or soda, ash ($Na_2CO_3$). These water-soluble surfactant species promote the dispersion of fines (silt and clay) in the oil sands ore, in turn promoting the liberation of bitumen and improving bitumen recovery efficiency for water-slurry-based extraction processes. Also, these water-soluble surfactant species promote the formation of bitumen-water emulsions under in situ recovery process conditions (e.g., ISC, SAGD, and CSS), thus improving bitumen recovery efficiency and also reducing the required water-to-oil (W/O) ratio.

The methods of the present invention can be used at a wide range of temperatures and pH values, by using pH-adjusting chemicals such as sodium hydroxide (NaOH), sodium carbonate ($Na_2CO_3$), and/or calcium hydroxide ($Ca(OH)_2$).

In preferred embodiments, the method of the invention uses air oxygen or an air-ozone mixture as an oxidation agent. When the method is used in association with water-slurry-based bitumen recovery systems, the oxidation agent is preferably injected into ore slurry transportation pipelines. This will enhance the development of air bubbles in the slurry and promotes the attachment of emulsified bitumen droplets to the air bubbles, which in turn enhances bitumen recovery efficiency in primary separation vessels in water-slurry-based recovery processes. This will also increase the oxidation agent's residence time (i.e., time in contact with bitumen in the ore), thus enhancing ore conditioning and production of surfactants by oxidation, sulfonation, and/or sulfoxidation of bitumen asphaltenes.

In accordance with an alternative embodiment, mined oil sands ore may be treated with ozone-air or other oxidation agents before being slurried with process water.

The effectiveness of surfactant production in accordance with the invention by oxidation of bitumen asphaltenes may be further enhanced by preheating the air, ozone-air, or other oxidation agents before injection into oil sands ore-water slurries or subsurface oil sand seams.

The production of surfactant species by oxidation, sulfonation, sulfoxidation, and/or sulfomethylation of bitumen asphaltenes in accordance with the present invention reduces surface and interfacial tension, which promotes the formation bitumen-water emulsions. The same reactions therefore can be used for the treatment of bitumen-water mixtures, as done in the oil sands ore-water slurry, to produce bitumen-water emulsions for the pipeline transportation of bitumen in the form of bitumen-water emulsions.

It will be readily apparent to persons skilled in the art that the methods of the present invention may also be adapted for use in association with bitumen-hydrocarbon mixtures and heavy oils. Persons skilled in the art will also appreciate that various means and mechanisms for introducing oxidation, sulfonation, sulfoxidation, and/or sulfomethylation agents into oil sand ore-water slurries or subsurface oil sands formation in accordance with the invention may be devised in accordance with known principles and technologies. Accordingly, the present invention is not dependent on or limited by any particular means by which these agents are introduced into an ore-water slurry or subsurface formation.

It will be readily appreciated by those skilled in the art that various modifications of the present invention may be devised without departing from the essential concept of the invention, and all such modifications are intended to be included within the scope of the appended claims.

In this patent document, the word "comprising" is used in its non-limiting sense to mean that items following that word are included, but items not specifically mentioned are not excluded. A reference to an element by the indefinite article "a" does not exclude the possibility that more than one of the element is present, unless the context clearly requires that there be one and only one such element.

The embodiments of the invention in which an exclusive property or privilege is claimed are defined as follows:

1. A method for producing surfactants from bitumen asphaltenes in oil sand in a subsurface oil sand formation, comprising the step of injecting one or more sulfonation agents into the subsurface oil sand formation and thereby exposing asphaltenes in the oil sand to the one or more sulfonation agents so as to induce sulfonation reactions whereby the asphaltenes are chemically modified to form surfactants.

2. The method of claim 1 comprising the further step of exposing the asphaltenes to one or more oxidation agents.

3. The method of claim 2 wherein the one or more oxidation agents comprise air oxygen.

4. The method of claim 2 wherein the one or more oxidation agents comprise ozone.

5. The method of claim 2 wherein the one or more oxidation agents comprise an air-ozone mixture.

6. The method of claim 1 wherein the one or more sulfonation agents comprise sulfur dioxide gas.

7. The method of claim 1 wherein the one or more sulfonation agents comprise sodium sulfite.

8. The method of claim 1 wherein the one or more sulfonation agents comprise sodium bi-sulfite.

9. A method for producing surfactants from bitumen asphaltenes in oil sand in a subsurface oil sand formation, comprising the step of injecting one or more sulfoxidation agents into the subsurface oil sand formation and thereby exposing asphaltenes in the oil sand to the one or more sulfoxidation agents so as to induce sulfoxidation reactions whereby the asphaltenes are chemically modified to form surfactants.

10. The method of claim 9 wherein the one or more sulfoxidation agents comprise petroleum coke utilization flue gas containing excess oxygen and sulfur dioxide.

* * * * *